United States Patent [19]

Crowe et al.

[11] Patent Number: 4,619,362

[45] Date of Patent: Oct. 28, 1986

[54] L-SHAPED SHIPPING CONTAINER

[75] Inventors: Stephen O. Crowe; Jeffrey D. Harper, both of Springhill, La.

[73] Assignee: International Paper Company, New York, N.Y.

[21] Appl. No.: 793,396

[22] Filed: Oct. 31, 1985

[51] Int. Cl.[4] ..... B65D 85/00

[52] U.S. Cl. ..... 206/326; 229/8; 229/16 R

[58] Field of Search ..... 206/326, 521; 229/37 R, 229/16 R, 44 R, 41 R, 41 B, 8, 23 R

[56] References Cited

U.S. PATENT DOCUMENTS

| | | | |
|---|---|---|---|
| 2,331,753 | 10/1943 | Wohlers | 206/326 |
| 2,346,003 | 4/1944 | Bishop | 229/41 B |
| 2,506,237 | 5/1950 | Roach | 229/41 B |
| 2,675,955 | 4/1954 | Gibbons | 206/326 |
| 2,832,525 | 4/1958 | Cavin | 229/23 |
| 3,259,295 | 7/1966 | Butz | 229/23 |
| 3,934,720 | 1/1976 | Kratochvil, Jr. | 206/326 |
| 3,978,982 | 9/1976 | Duncan | 206/326 |
| 4,098,401 | 7/1978 | Brown et al. | 206/326 |
| 4,111,301 | 9/1978 | English | 206/326 |
| 4,114,755 | 9/1978 | Aust | 206/326 |
| 4,126,222 | 11/1978 | Aust | 206/326 |
| 4,185,741 | 1/1980 | Schiff et al. | 206/326 |
| 4,398,902 | 8/1983 | Mangum | 206/326 |

FOREIGN PATENT DOCUMENTS

| | | | |
|---|---|---|---|
| 227603 | 10/1962 | Austria | 206/326 |

*Primary Examiner*—William Price
*Assistant Examiner*—Gary E. Elkins
*Attorney, Agent, or Firm*—Richard J. Ancel

[57] ABSTRACT

A one piece substantially rectangular corrugated paperboard blank is folded into a generally L-shaped container for packaging a chair. It includes back, side and lower front panels. Foldably attached to and partly separated from these panels and from each other are a panel and flaps for forming and reinforcing a lower top, an upper top and an upper front. These include a pair of flaps extending along the entire transversely disposed side edges of the lower top panel to strongly attach it to the side panels.

8 Claims, 4 Drawing Figures

L-SHAPED SHIPPING CONTAINER

BACKGROUND OF THE INVENTION

This invention relates to a generally L-shaped corrugated paperboard carton in which to ship an article of furniture such as a chair, and a blank for forming the carton.

The packaging industry has developed form fitting cartons for packaging various odd shaped articles. For packaging chairs, particularly upholstered chairs, the accepted style is to make a carton blank from which to form an L-shaped container which is placed over the chair and secured with some form of bottom.

The developments by the various members of the industry appear to be quite similar. But each has its limitations and constant attempts are made to improve and particularly to strengthen these odd shaped products. At the same time, it is considered essential to provide a blank which can be shipped in flat condition to the chair packager after being preliminarily formed into a tube by the blank manufacturer.

It is accordingly the general object of this invention to provide an improved chair carton and a blank for making it which can be thus shipped flat.

SUMMARY OF THE INVENTION

As will appear in the more detailed description and drawings, the carton is substantially rectangular in shape, is formed from one piece of corrugated paperboard and has from one end to the other in the order named a back, a side, a lower front and another side panel.

Foldably attached to the upper edge of the lower front panel is a lower top panel for providing a horizontal cover over the arm and seat portions of the chair.

Upper front panels are formed by foldable attachments along side edges to the upper parts of the side panels for forming an upper front portion in front of the seat of the chair.

Flaps are provided for securing the parts together. Among these, and most importantly for imparting strength and rigidity to the carton, and therefor comprising a substantial essence of invention, are a pair of flaps extending preferably along the entire transverse side edges of the lower top panel for securing the latter to the lower parts of the side panels.

DETAILED DESCRIPTION

Figure 1:
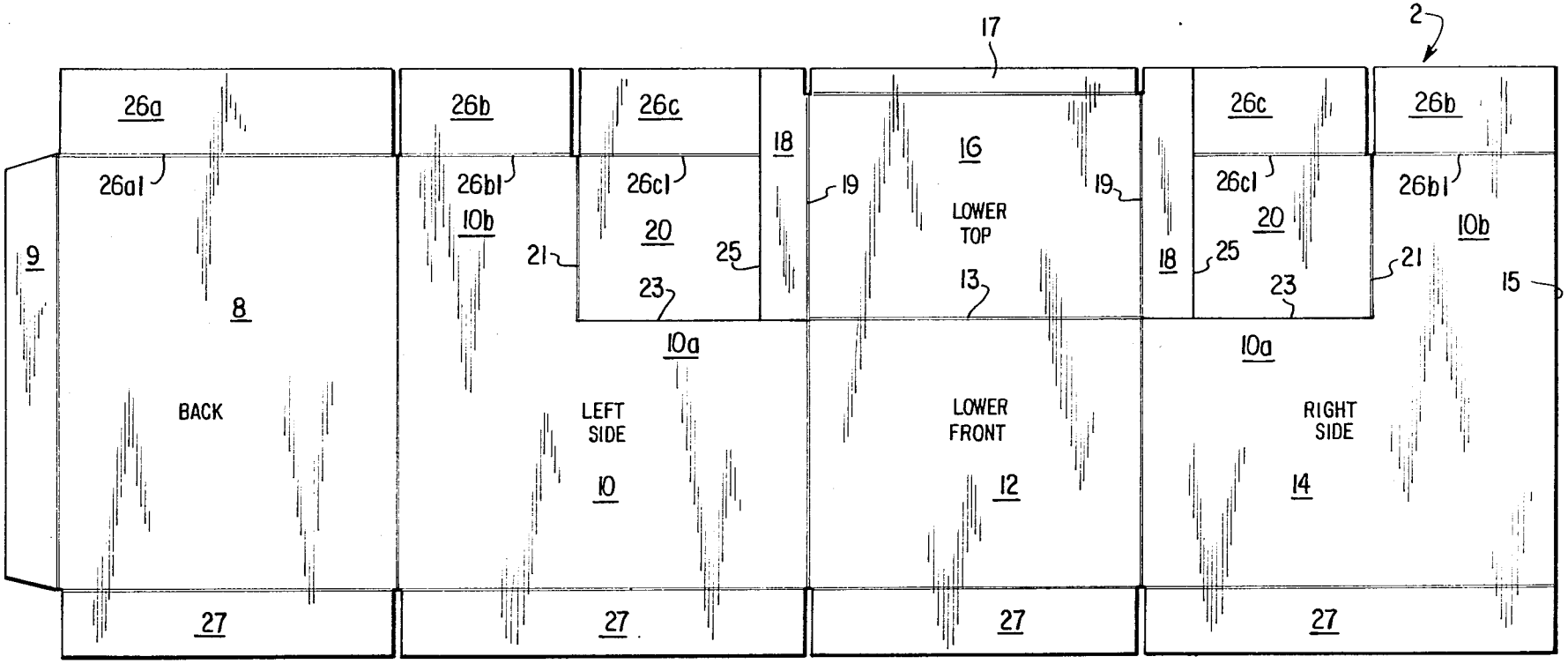
FIG. 1 is a view of the blank laid out flat for making the carton which embodies the invention.
Figure 2:
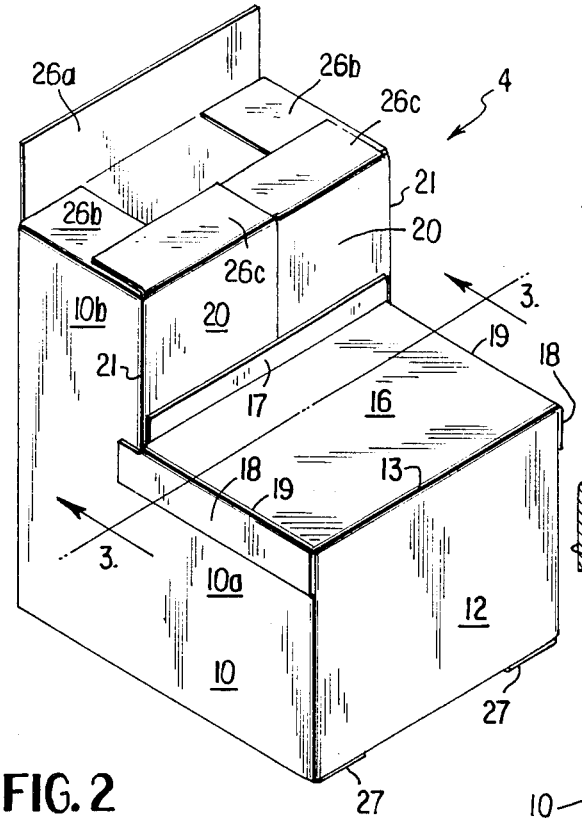
FIG. 2 is a perspective view of the carton of the invention formed by the blank.
Figure 4:
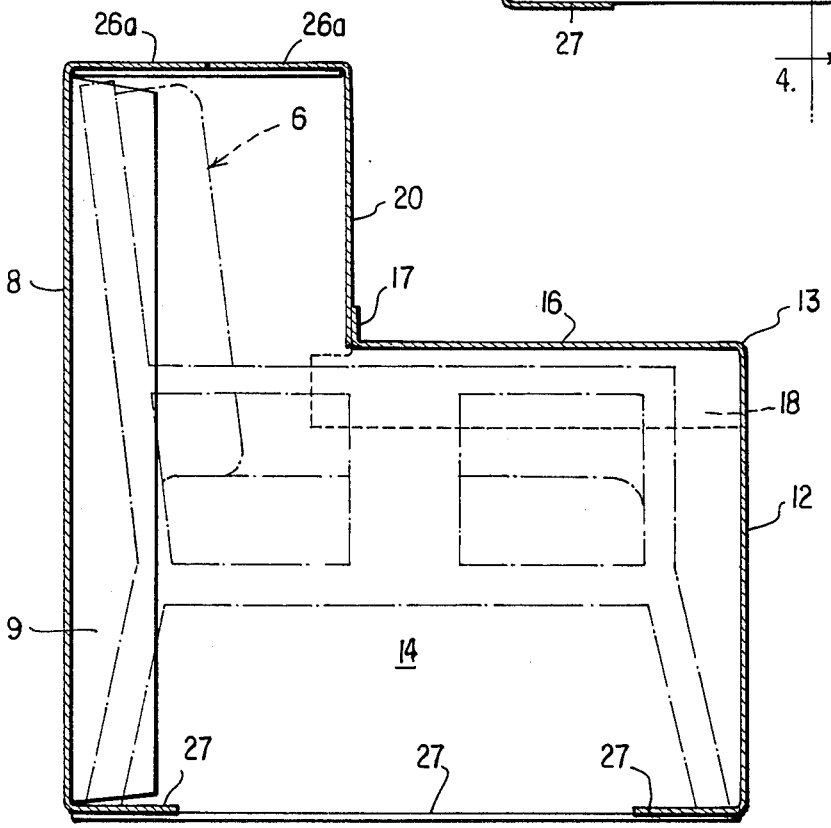
FIG. 4 is a view mostly in section taken along the lines 4—4 through FIG. 3 also indicating a chair contained in the carton.

A one piece substantially rectangular corrugated paperboard blank is indicated at 2 in FIG. 1 from which to make a generally L-shaped carton indicated at 4 in FIG. 2 in which to ship an article of furniture such as an easy chair indicated at 6 in FIG. 4.

It includes, in the order named from one end of the carton to the other, a back panel 8, a left hand side panel 10 (as viewed from the front of the carton as seen in FIG. 2), a lower front panel 12 and a right hand side panel 14.

A lower top panel 16 is foldably attached to the upper edge 13 of the lower front panel 12 for forming a lower top of the carton 4 disposed over the arm portions of the chair 6 as seen in FIGS. 2 and 4. It has a gluing tab 17 for a purpose to be described.

The lower top panel 16 also has lower top panel flaps 18 which provide important and essential parts of the blank and carton of this invention. These flaps 18 are foldably attached to and extend along preferably the entire transversely disposed side edges 19 of the lower top panel 16 for the purpose of attaching them as by gluing to the lower parts **10*a* of the side panels 10 and 15 (as seen in FIG. 2**) to provide strength and rigidity which has been lacking in previous cartons of a similar type.

Upper front panels 20 are formed by foldable attachment along side edges 21 to the upper parts **10*b* of the side panels 10 and 14**.

The lower top panel flaps 18 and the upper front panels 20 are further defined by longitudinal slits 23 at their bottom edges and transverse slits 25 separating them from each other and defining their outer transverse side edges.

Upper top forming flaps **26*a*, 26*b* and 26*c* are foldably attached respectively to the upper edges 26*a* 1, 26*b* 1, 26*c* 1 of the back panel, the side panels and the upper front panels for forming the upper top of the carton 4 when folded over and secured as by gluing above the back of the chair as seen in FIGS. 2 and 4**.

Figure 3:
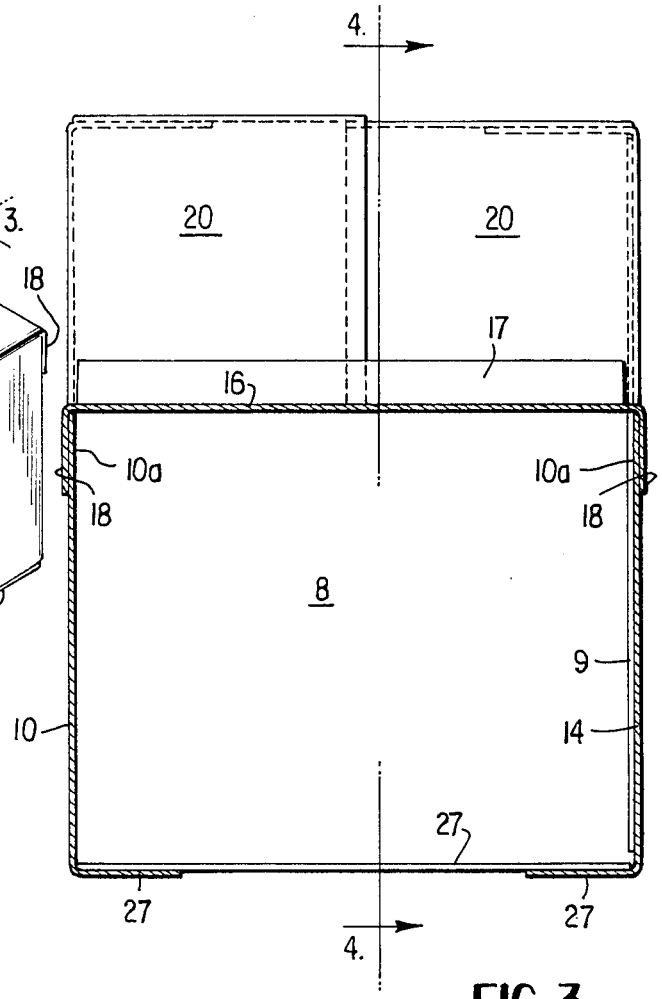
FIG. 3 is a view mostly in section taken along the lines 3—3 of FIG. 2.

Glue tabs or flaps 27 may be arranged along the bottom edge of the blank and foldably connected to its panels for forming the bottom of the carton when folded under and secured as by gluing to a bottom panel 28 as seen in FIGS. 3 and 4.

The back panel 8 may have a transverse glue tab or flap 9 by which its outer edge may be attached to the outer edge 15 of the other end of the blank 2 thus allowing the carton to be folded over and secured to form a tube which may be collapsed and shipped flat by the blank manufacturer and then erected by the chair packager into a quadrilateral structure when forming the carton as shown in FIGS. 2, 3 and 4.

When the carton 4 is being erected (as seen in FIG. 2), the upper top forming flaps **26*b* are folded down horizontally, the upper front panels 20 are folded with one edge over the other vertically and their upper top forming flaps 26*c* are folded down horizontally over the flaps 26*b*. Then the top forming flap 26*a* is folded down horizontally over the others to complete the upper top with these parts secured to each other as by gluing. The lower top panel is folded down horizontally and its glue tab or flap 17 is secured to the upper front panels 20**.

Finally, the lower top panel flaps 18 are folded down against the lower parts **10*a* of the side panels 10 and secured as by gluing thus forming a strong and rigid structure over the seat and arms of the chair 6** having the characteristics of a box beam.

What is claimed is:

1. A one piece, substantially rectangular paperboard blank for a generally L-shaped carton in which to ship an article of furniture such as a chair, said blank including a plurality of generally rectangular panels and flaps each having an upper edge, a lower edge, and two vertical side edges, (a) back, left side, lower front and right side panels in the order named from a left end of the blank to a right end, said side panels each having lower and upper parts;

(b) a lower top panel foldably attached at its lower edge to the upper edge of the lower front panel;

(c) lower top panel side flaps each foldably attached at one of its side edges to a respective side edge of said lower top panel;

(d) upper front panels each formed from an upper portion of a respective side panel, each upper front panel foldably attached along one of its vertical side edges to an upper part of a respective side panel and further defined by a horizontal slit at its lower edge and by a vertical slit along its other vertical side edge, said horizontal and vertical slits also defining, respectively, the lower and the other side edge of each lower top panel side flap;

(e) upper top forming flaps foldably attached to the upper edges of said back, side and upper front panels.

2. a carton blank of claim 1 wherein the upper edge of the lower top panel is provided with a foldable glue tab.

3. A carton blank as set forth in claim 1 in which one of the vertical side edges of said back panel has a glue tab by which said one edge of the back panel may be attached to one of the side edges of the right side panel.

4. A carton blank as set forth in claim 1 in which each of said lower top panel side flaps extends along the entire extent of the side edges of said lower top panel.

5. A carton blank as set forth in claim 1 having tabs along the lower edges of the back, side, and lower front panels for forming a bottom of a carton formed from the blank.

6. A carton formed from the blank as set forth in claim 1.

7. A generally L-shaped carton in which to ship an article of furniture such as a chair, said carton formed from a plurality of generally rectangular panels and flaps each having an upper edge, a lower edge, and two side edges, including:

(a) a lower front panel, two side panels, a back panel, each being vertically disposed, said side panels each having upper and lower;

(b) a horizontal lower top panel foldably attached to the upper edge of the lower front panel;

(c) lower top panel side flaps foldably attached to the side edges of said lower top panel, said flaps securing said lower top panel to the lower parts of said side panels;

(d) vertically disposed upper front panels each foldably secured to one of said side edges of one of said side panels;

(e) the lower top panel carrying a glueing tab, said glueing tab being vertically disposed and secured to the upper front panels.

8. In the carton as set forth in claim 7, said lower top panel side flaps extending towards the back panel past the upper front panels, along the entire side edges of said lower top panel.

* * * * *